US008840210B1

(12) United States Patent
Martinez de Salinas Vazquez et al.

(10) Patent No.: US 8,840,210 B1
(45) Date of Patent: Sep. 23, 2014

(54) PRINT SYSTEM WITH VARIABLE PRINT SPEED

(71) Applicant: Hewlett-Packard Development Company, L.P., Houston, TX (US)

(72) Inventors: Jorge Martinez de Salinas Vazquez, Sant Cugat del Valles (ES); Lluis Abello Rosello, Sant Cugat del Valles (ES); Joan Vidal Fortia, Sant Cugat del Valles (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/905,593

(22) Filed: May 30, 2013

(51) Int. Cl.
*B41J 29/38* (2006.01)
*B41J 2/07* (2006.01)

(52) U.S. Cl.
CPC ..... *B41J 2/07* (2013.01)
USPC ..... 347/14; 347/15

(58) Field of Classification Search
USPC ..... 347/12–15
See application file for complete search history.

(56) References Cited

U.S. PATENT DOCUMENTS

| | | | | |
|---|---|---|---|---|
| 5,326,183 | A | 7/1994 | Kasai et al. | |
| 5,349,905 | A * | 9/1994 | Taylor et al. | 101/488 |
| 5,373,312 | A * | 12/1994 | Fujioka et al. | 347/102 |
| 5,714,990 | A * | 2/1998 | Courtney | 347/14 |
| 6,174,037 | B1 | 1/2001 | Donahue et al. | |
| 6,234,695 | B1 * | 5/2001 | Freedman et al. | 400/120.01 |
| 6,891,556 | B2 | 5/2005 | Sasaki et al. | |
| 2002/0135631 | A1 * | 9/2002 | Sasaki et al. | 347/19 |
| 2005/0007607 | A1 * | 1/2005 | Kitamura et al. | 358/1.8 |

FOREIGN PATENT DOCUMENTS

| | | |
|---|---|---|
| KR | 20070066128 | 6/2007 |

* cited by examiner

*Primary Examiner* — Julian Huffman
*Assistant Examiner* — Sharon A Polk

(57) ABSTRACT

An image may be printed at variable speed. An image density profile provides an estimation of power to be consumed while printing the image. A power consumption profile is generated based on the image density profile and by taking into account distance offsets between nozzles that are used to print the image. The image may be printed at different speeds based on the power consumption profile.

17 Claims, 4 Drawing Sheets

PRINT SYSTEM WITH VARIABLE PRINT SPEED

BACKGROUND

Some Inkjet printers produce images by moving a printhead with an array of nozzles across a sheet of media, such as paper. The printhead is controllable to eject ink drops from each nozzle onto the media. As the ink drops impact the page, the drops may spread and may be absorbed into the media. At idle conditions, inkjet printers require minimal power, but require high power under high speed, high image density conditions.

BRIEF DESCRIPTION OF THE DRAWINGS

The following detailed description references the drawings, wherein.

DETAILED DESCRIPTION

Examples disclosed herein provide adjustable print speeds to print an image based on image density and distance offsets between nozzles. A density of an image to be printed is measured to provide a density profile for the image. The distance offset between nozzles to be fired to print the image is determined. The distance offsets may be column-to-column between nozzles of the same color on the same print die, color-to-color between nozzles of different colors on the same print die, die-to-die between adjacent print die, and printhead-to-printhead between adjacent printheads. A power consumption profile is generated based on the density profile of the image and the distance offsets to identify the amount of power necessary to print the image. Using the power consumption profile, a print speed graph may be generated to identify the print speeds at which the image may be printed. The image may then be printed at the different print speeds such that denser portions of the image may be printed more slowly than less dense portions of the image.

Figure 1:
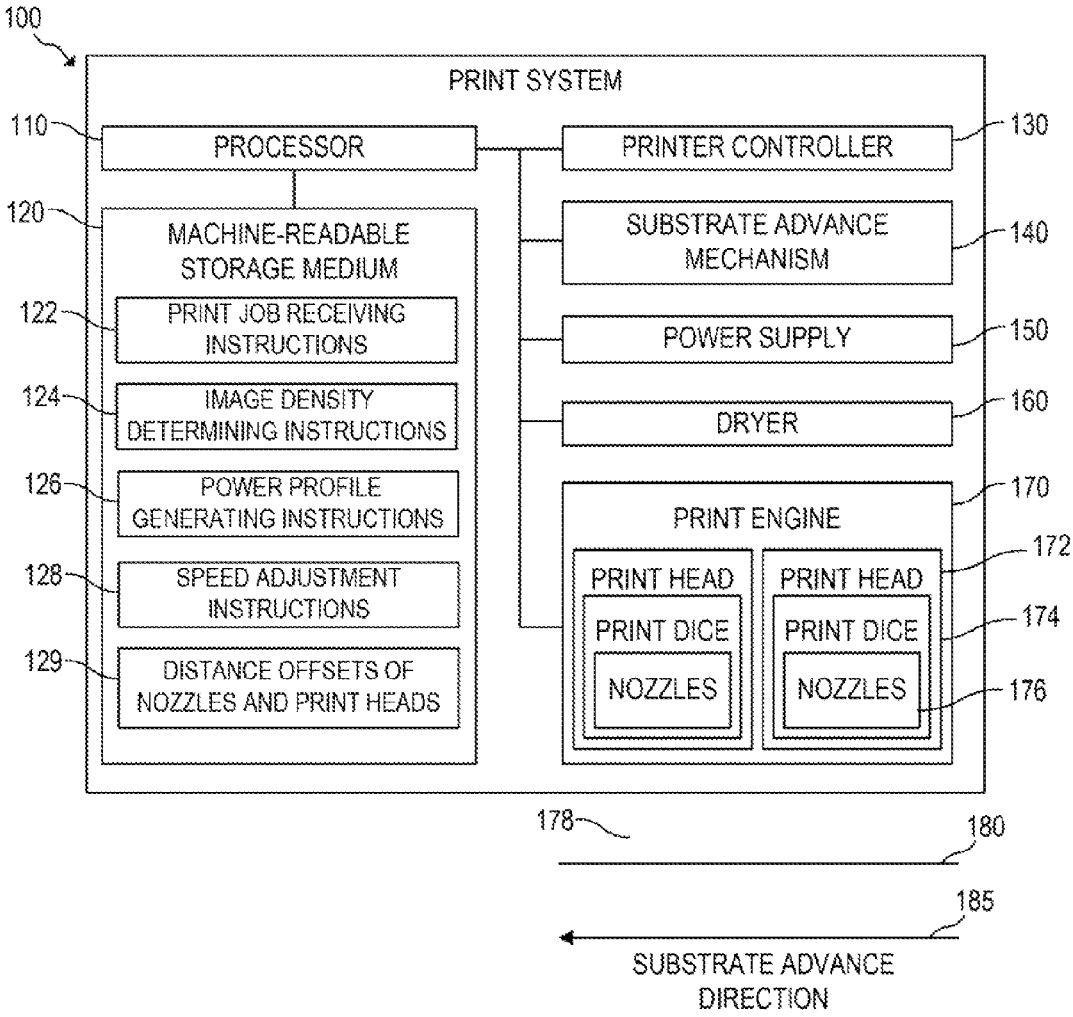
FIG. 1 is a block diagram of an example print system.

Referring now to the drawings, FIG. 1 is a block diagram of an example print system 100. Print system 100 comprises a print engine 170 for depositing printing fluid on a portion of a substrate 180 positioned in a print zone 178. Printing fluids may, for example, include inks, pre-treatments, and post-treatments such as varnish. In one example, print engine 170 comprises one or multiple printheads 172. Printheads 172 may be inkjet printheads, thermal inkjet printheads, or piezo inkjet printheads. Each printhead 172 may include one or multiple print dies 174. Each print die 174 may include multiple nozzles 176. Each nozzle 176 may correspond to a particular ink color such as cyan, yellow, magenta or black.

Operation of print system 100 is generally controlled by a printer controller 130. For example, printheads 172 may be controllable by print controller 130, in accordance with image data, such as printhead control data, representing an image to be printed. Printheads 172 are controlled to eject drops of printing fluid from nozzles 176 onto substrate pixel locations of a substrate 180, such as a sheet of paper, positioned in print zone 178.

In one example, printheads 172 are mounted on a carriage (not shown) that is movable bi-directionally in an axis perpendicular to and in a plane parallel to a substrate advance direction 185. Accordingly, printheads 172 are able to print an image swath along the whole, or substantially the whole, width of substrate 180.

Each swath may be printed using one or multiple passes of the carriage across the width of substrate 180. Once each swath is printed, substrate 180 is advanced in substrate advance direction 185 by a suitable substrate advance mechanism 140 so that a subsequent swath may be printed adjacent to or overlapping a previously printed swath.

In another example, printheads 172 of print engine 170 are arranged in a page-wide array configuration, for example on a print bar, which spans the whole, or substantially the whole, width of substrate 180. In this example, substrate advance mechanism 140 continuously advances substrate 180 under print zone 178 in substrate advance direction 185. In some examples print engine 170 and print zone 178 are partially enclosed by a housing (not shown).

Print system 100 prints a print job using a collection of printing system configuration parameters defined in a print mode. Printing system 100 may use a default print mode, or an operator may select from a choice of multiple print modes depending on particular requirements. The choice of print mode may be made, for example, through a print driver or via a user interface (not shown) of print system 100. In one implementation, a user may select a print mode that causes print system 100 to print an image using an adjustable print speed, as described below.

Referring to FIG. 1, print system 100 includes a processor 110, a machine-readable storage medium 120, a power supply 150 for providing power to components of print system 100, and a dryer 160 for drying print fluids provided on substrate 180 by nozzles 176. Processor 110 may be one or more central processing units (CPUs), microprocessors, and/or other hardware devices suitable for retrieval and execution of instructions 122, 124, 126, 128 stored in machine-readable storage medium 120. Processor 110 may fetch, decode, and execute instructions 122, 124, 126, 128 to control print speed based on image density, as described below. As an alternative or in addition to retrieving and executing instructions 122, 124, 126, 128, processor 110 may include one or more electronic circuits comprising a number of electronic components for performing the functionality of one or more of instructions 122, 124, 126, 128.

Machine-readable storage medium 120 may be any electronic, magnetic, optical, or other physical storage device that stores executable instructions. Thus, machine-readable storage medium 120 may be, for example, Random Access Memory (RAM), an Electrically-Erasable Programmable Read-Only Memory (EEPROM), a storage drive, an optical disc, and the like. As described below, machine-readable storage medium 120 may be encoded with executable instructions 122, 124, 126, 128 for controlling print speed based on image density and distance offsets of nozzles and printheads used to print an image. Machine-readable storage medium 120 may also store distance offsets of nozzles and printheads 129, as described below.

Print job receiving instructions 122 may receive a print job. The print job may include an image to be printed. The image may include dense portions (e.g., a photograph), less dense portions (e.g., text), and blank portions.

Image density determining instructions 124 may measure the density of the image to be printed and provide a density profile of the image. Image density may be measured by counting drops of ink to be fired per unit of time. An image pixel may be split into defining channels such that if print system 100 includes inks for magenta, yellow, cyan and black, there are image buffers that correspond to each ink color. For each buffer, bit data values may indicate no ink firing, or an actual number of ink drops to be fired.

The density profile is used to establish an estimation of power to provide to printheads 172 to print the image. The image buffers may be analyzed taking into account which nozzles 176 are to be fired and the relative position of those nozzles 176. Distance offsets of nozzles and printheads 129 may include data that identifies a distance between nozzles 176 and printheads 172. Since power consumption may be determined per unit of time by using the position of a nozzle or a printhead, distance offsets of nozzles and printheads 129 may be used together with the density profile of the image to configure different speeds for printing substrate 180.

To provide an accurate measure of power consumption at a given point in time, image density determining instructions 124 may compensate for the distance offsets off 176 and printheads 172. The distances may be a column-to-column offset between nozzles arranged in different columns of the same print die, a color-to-color offset between nozzles of different colors on the same die, a die-to-die offset between nozzles of the same color on different print dies, and a printhead-to-printhead offset between adjacent printheads.

Power profile generating instructions 126 may generate a power profile for printing the image based on the density profile of the image and the distance offsets of nozzles and printheads. Generally, the denser the portion of the image, the more power is necessary to power printheads 172 to fire nozzles 176. In addition, the larger the dense portion of the image, the more power is required to dry substrate 180. The power profile may be generated based on an amount of power consumed by each nozzle. The amount of power consumed by a nozzle may be identified based on an ink type of the nozzle and a number of drops output from the nozzle.

Speed adjustment instructions 128 may adjust the speed at which the image is printed. The speed for printing the image may be adjusted based on the power profile. Generally, denser portions of an image may be printed at slower speeds than less dense portions of the image. In one implementation, the speed at which the image is printed is reduced when the power profile exceeds a threshold (e.g., at peak power consumption). Similarly, in another implementation, the speed at which the image is printed is increased when the power profile does not exceed a threshold.

In some implementations, during periods of peak power consumption, some components of print system 100 (e.g., dryer 160) may be powered down to provide additional power to printheads 172.

The estimation of power consumption while printing an image prevents the over-dimensioning of power supply 150. The estimation of power consumption also allows for printing at maximum speed. If printing an image exceeds maximum power ratings, and nothing is done, then power supply 150 or printheads 172 may incur a voltage drop. In this case, smaller drops may be fired from nozzles 176 or drops may be fired at a slower velocity which may translate into image defects on substrate 180.

Figure 2:
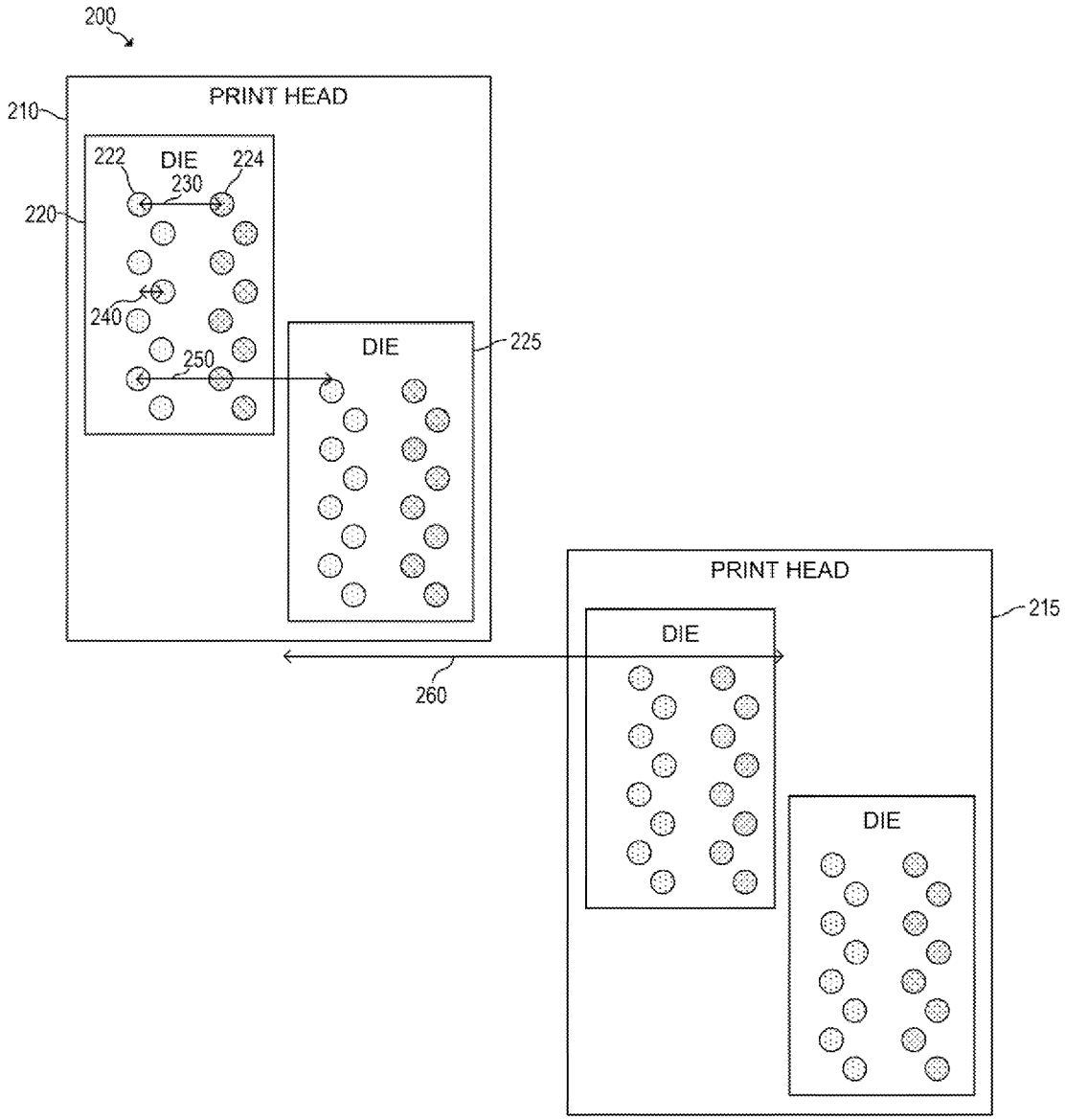
FIG. 2 is a diagram of two printheads of an example print system.

FIG. 2 is a diagram of two printheads 210, 215 of a print system 200. Each printhead 210, 215 may include two print dies 220, 225. Each print die may include nozzles 222, 224 that may correspond to the same ink color or different ink colors. To simplify description, nozzles 222 correspond to magenta colored ink, and nozzles 224 correspond to cyan colored ink. However, nozzles 222, 224 may also correspond to yellow ink and black ink.

Nozzles 222, 224 may be arranged in columns and may be staggered. Two adjacent nozzles in a vertical direction of the image may be displaced approximately 1200 dots per inch apart and in a horizontal direction may also be displaced approximately 1200 dots per inch apart. The horizontal axis may be the time axis.

To simplify description, print system 200 is described with reference to printhead 210. Printhead 210 may be static such that substrate 180 approaches from the right side and travels under printhead 210. Accordingly, substrate 180 first approaches cyan nozzles 224 of print die 220, and print die 220 may start firing the image onto substrate 180. A few milliseconds later substrate 180 may approach magenta nozzle 222 of print die 220 such that both magenta and cyan colored inks may be firing portions of the image onto substrate 180. Substrate 180 may move from right to left so that only the magenta nozzles 222 are firing. In other words, to print an actual pixel, firing may begin at some initial time for cyan nozzle 224 at some later time for magenta nozzle 222. The different nozzles are typically separated physically and the drops are layered on top of each other on substrate 180. The difference in time is translated into power consumption by counting the drops to be provided on the image while taking into account the distance offsets between nozzles 222, 224.

In one example, the distance offsets of nozzles may be a column-to-column offset 240 between nozzles of the same print die that correspond to the same color and that are arranged in different columns. In another example, the distance offsets of nozzles may be a color-to-color offset 230 between nozzles of the same print die that correspond to different colors. In a further example, the distance offsets of nozzles may be a die-to-die offset 250 between nozzles of adjacent print dies that correspond to the same color. In a yet another example, the distance offsets of nozzles may be a printhead-to-printhead offset 260 between print dies of adjacent printheads.

A single pixel of an image may be fired by different nozzles at different points in time since the nozzles are physically separated on the print die. Accordingly, the position of the pixel contributes to the power consumption at different points in time for different colors. The distance offsets (e.g., column, color, die) are illustrated in Table 1 for individual pixels of an image.

TABLE 1

| Pixel (row, column) | Color | Column Offset | Color Offset | Die Offset | Total Offset |
|---|---|---|---|---|---|
| 0, 0 | cyan | 0 | 0 | 0 | 0 |
| 0, 0 | magenta | 0 | 48 | 0 | 48 |
| 1, 0 | cyan | 10 | 0 | 0 | 10 |
| 1, 0 | magenta | 10 | 48 | 0 | 58 |
| . . . | | | | | |
| 1056, 0 | cyan | 0 | 0 | 800 | 800 |
| 1056, 0 | magenta | 0 | 48 | 800 | 848 |
| 1057, 0 | cyan | 10 | 0 | 800 | 810 |
| 1057, 0 | magenta | 10 | 48 | 800 | 858 |

Printing a single pixel contributes to the power consumption of a print system. For example, pixel 0 contributes to time 0 and time 48, and pixel 1 contributes to time 10 and time 58. These offsets are taken into account to provide a power consumption profile.

In Pixel (row, column), the row is equivalent to a nozzle number. At pixel (0, 0), cyan and magenta are provided. The cyan nozzle has a total offset of zero. For the magenta nozzle provided to the left of the cyan nozzle, the offset is measured to be 48. At pixel (1, 0), which is the cyan nozzle below the (0, 0) cyan nozzle, the offset is 10. Magenta nozzle (1, 0) has an offset of 58 relative to the original cyan nozzle (0, 0).

In this example, there may be 1056 total nozzles in a printhead; in other example, may or less nozzles may be present in a printhead. At the bottom of Table 1, an offset of 800 corresponds to an offset on the horizontal axis of the cyan nozzle (1056, 0) relative to the original cyan nozzle (0, 0). At a given time, when the cyan nozzle (0, 0) is firing, the cyan nozzle (1056, 0) located in a different die with die offset 250 is 800 pixels away from firing. The actual physical location of the nozzles is represented in pixel units. Accordingly, by adding the density of the pixels with a corresponding offset, the number of drops that need to be fired at a particular instant in time may be counted.

In some implementations, print system 200 may include more than one printhead. The additional printhead may be provided adjacent to the original printhead. The additional printhead may include the same arrangement of nozzles. Instead of doing multi-pass printing with a single printhead, multiple printheads can print faster with fewer passes. For printers with more than one printhead, the power consumption profile is generated using printhead-to-printhead offset 260. And the total power is distributed across printheads 210, 215. In addition, the nozzles of different printheads may be fired at different points in time due to the physical distance between the printheads.

Figure 3:
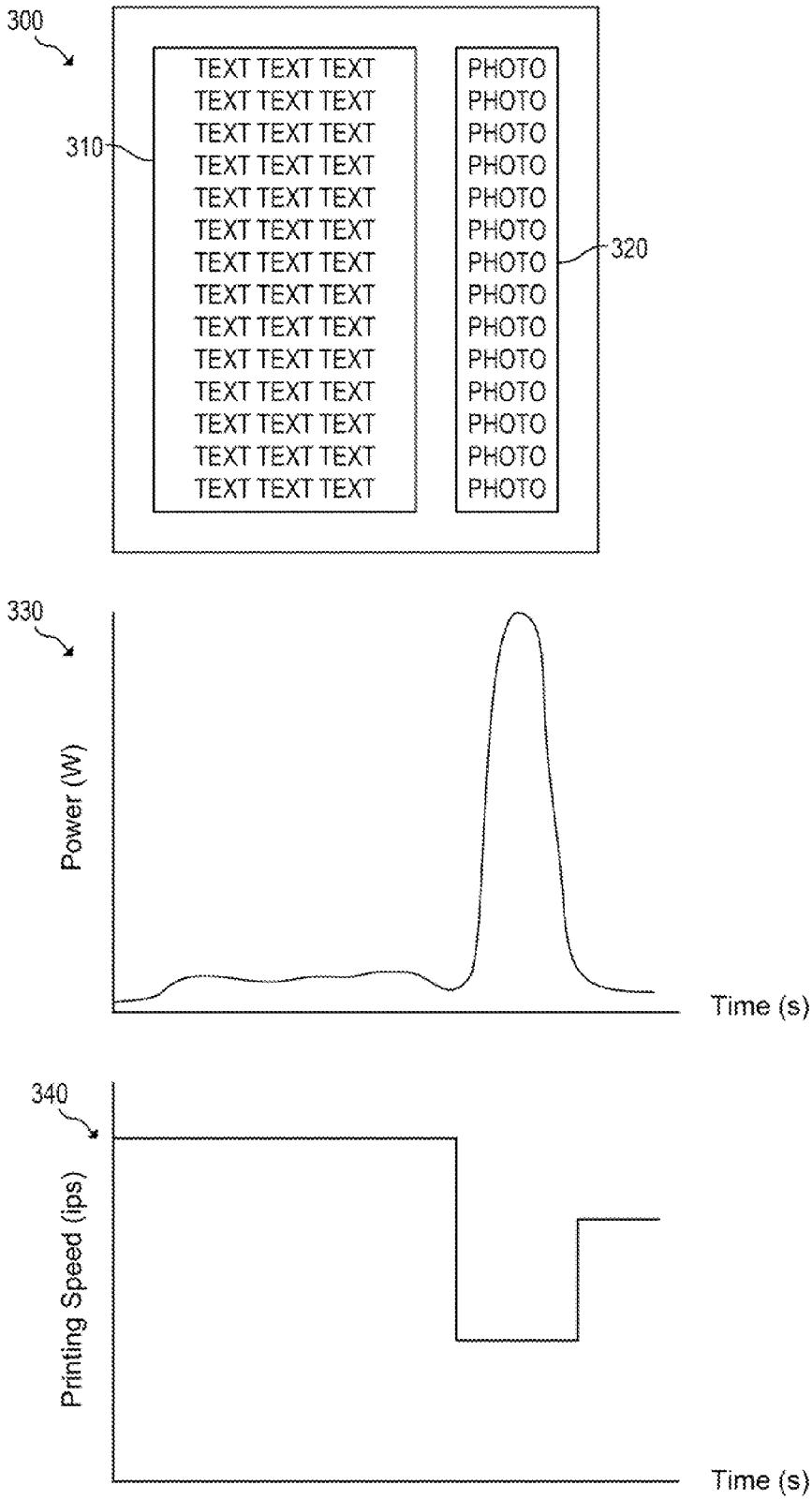
FIG. 3 illustrates an example image to be printed, an example power consumption profile and an example print speed graph.

FIG. 3 illustrates an image 300 to be printed, a power consumption profile 330 for image 300, and printing speed graph 340 for image 300 based on power consumption profile 330. Image 300 may include text 310 and a photo 320.

The density of the pixels of image 300 is determined and added with the corresponding offsets as described with reference to FIG. 2. Power consumption profile 330 is then generated for image 300. Power consumption profile 330 represents the power (y-axis) required per unit of time (x-axis) to print image 300. On the left side of power consumption profile 330, minimum power is required to print text 310 of image 300. On the right side of power consumption profile 330, a larger amount of power is required to print photo 320 of image 300. The print system can accommodate the printing speed of each region of image 300 in accordance with the power requirements provided in power consumption profile 330.

The printing speed of image 300 may be adjusted based on the density profile of the image and the distance offsets of nozzles to be fired, as shown in printing speed graph 340. The y-axis of the printing speed graph 340 corresponds to a speed of substrate 180 moving through print zone 178 and the x-axis corresponds to units of time. The speed may be adjusted according to the power needed to print different portions of image 300. Low density portions (e.g., text 310) of image 300 may be printed faster while denser portions (e.g., photo 320) are printed more slowly. For example, print speed may begin at a faster speed (e.g., 10 inches per second) because less power is required to print text. When photo 320 is being printed, print speed may be reduced to a lower value (e.g., 5 inches per second). When photo 320 printing is complete, print speed may then increase.

In some implementations, instead of changing the speed of printing based on density and distance offsets, power may be temporarily removed from other subsystems of the printer to provide the additional power required by the firing system during peak consumption. For example, a substrate may be continuously printed at 10 inches per second. When a peak power region is encountered, in order to not consume more power than available, an electronic component that is not being used, such as dryer 160, may be shut down.

In some implementations, the power peaks may be detected and the substrate may be printed at a constant speed that consumes less than peak power when image 300 is printed.

Figure 4:
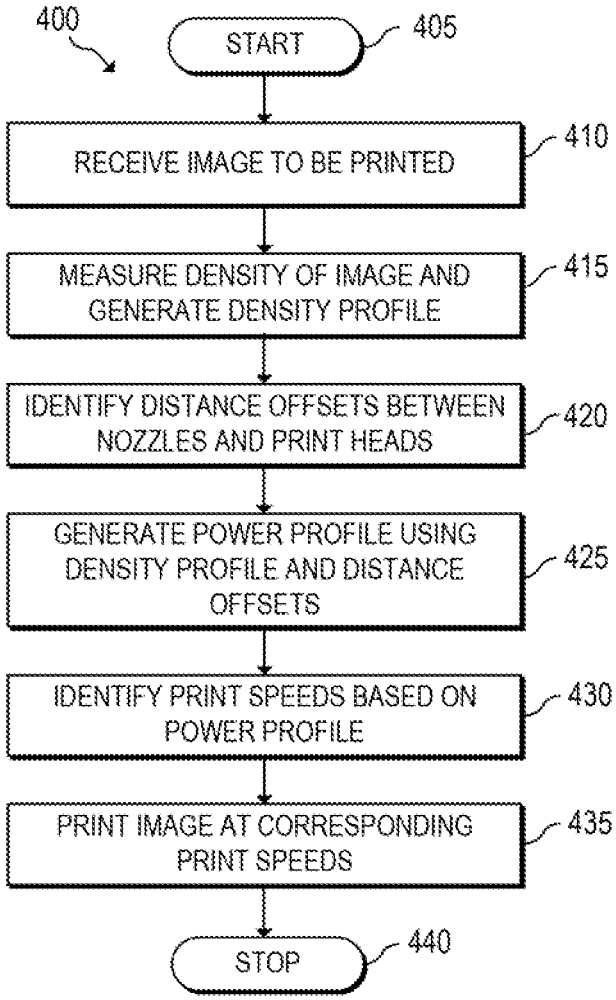
FIG. 4 is a flowchart of an example method for execution by a print system.

Referring now to FIG. 4, there is shown a flow diagram outlining an example method 400 of operating a print system. In one example, method 400 may be performed by printer controller 130.

Method 400 may start in block 405 and continue to block 410, where a print job is received. The print job may include at least one image to be printed on a substrate. The image may include dense regions (e.g. a photograph), regions that are not as dense (e.g., text), and blank regions.

Next, in block 415, a density of the image to be printed is measured and a density profile of the image is generated based on the density measurements. Image density may be measured by counting drops of ink to be fired per unit of time. The more drops of ink to be fired at a given instant of time, the more power that will be required at that time. The density profile of the image provides an estimation of power to provide to the printheads to print the image.

In block 420, the distance offset between nozzles may be identified. The distance offset may be between nozzles of the same color arranged in different columns, between nozzles of different colors on the same print die, or between nozzles of the same color arranged on different print dies. In the case of two or more printheads, the distance offset of the printheads may also be identified. By identifying which nozzles are to be fired and the relative position of those nozzles, the estimation of power consumed by the print system may be further refined by considering the distance offsets between the nozzles to be fired.

Next, in block 425, a power consumption profile for printing the substrate is generated per unit of time using the density profile of the image and the distance offsets of the nozzles and printheads. The power consumption profile for printing the image generally indicates that a denser portion of the image requires more to power to be printed than lower density portions of the printer. In addition, pixels of the image that are to be printed by different nozzles that are physically distanced from each other by greater offsets may also require more power to print that pixel.

In block 430, the print speeds of the print job are identified using the power consumption profile. Generally, the print speed is higher for portions of the image that do not require much power, and the print speed is decreased for portions of the image that require peak power.

Finally, in block 435, the image is printed at the corresponding print speeds. The print speed may be adjusted to account for the power consumption profile of the image at a given point in time. Method 400 may subsequently proceed to block 440, where method 400 may stop.

The foregoing disclosure describes a number of example methods of operating a print system by adjusting a print speed based on image density and distance offsets of nozzles and printheads to be fired while printing the image. In this manner, the examples disclosed herein provide a print system that can print as fast as allowed by a power budget of the print system.

We claim:

1. A method of controlling a print system, the method comprising:

obtaining an image to be printed on a substrate;

obtaining a density profile of the image;

identifying nozzles to be used to print the image;

obtaining a distance offset of the nozzles;

generating a power profile for printing the image, wherein the power profile is generated based on the density profile of the image and the distance offset, the power profile indicating an amount of power to be consumed over time to print the image; and printing different portions of the image at different speeds according to the power profile.

2. The method of claim 1, wherein printing different portions of the image comprises decreasing the speed at, which the image is printed when power consumption of the print system exceeds a predetermined threshold.

3. The method of claim 1, wherein printing different portions of the image comprises increasing the speed at which the image is printed when power consumption of the print system does not exceed a predetermined threshold.

4. The method of claim 1, wherein the nozzles are provided in columns on a print die, the distance offset comprising a distance between nozzles of the same color in different columns.

5. The method of claim 1, wherein the nozzles are provided in columns on a print die, the distance offset comprising a distance between nozzles of a different color in different columns.

6. The method of claim 1, wherein the nozzles are provided in columns on at least two print dies, the distance offset comprising a distance between nozzles of the same color on different print dies.

7. The method of claim 1, wherein the nozzles are provided on at least two printheads, the distance offset comprising a distance between adjacent printheads.

8. The method of claim 1, further comprising reducing power provided to a component of the print system when power consumption of the print system exceeds a threshold.

9. The method of claim 1, wherein generating the power profile comprises identifying an amount of power to be consumed by each of the nozzles, the amount of power being identified based on an ink type of the nozzle and a number of drops output from the nozzle.

10. A machine-readable storage medium encoded with instructions executable by a processor of a print system for controlling a print speed of an image, the machine-readable storage medium comprising:

instructions for receiving an image to be printed on a substrate, instructions for determining a density profile of the image, instructions for generating a power consumption profile, wherein the power consumption profile is generated based on the density profile of the image and distance offsets of nozzles to be used to print the image, the power consumption profile indicating an amount of power to be consumed over time to print the image, and instructions for adjusting a speed at which the image is printed based on the power profile.

11. The machine-readable storage medium of claim 10, wherein the instructions for adjusting a speed at which the image is printed decreases the speed at which the image is printed when the amount of power exceeds a threshold.

12. The machine-readable storage medium of claim 10, wherein the instructions for adjusting a speed at which the image is printed increases the speed at which the image is printed when the amount of power does not exceed a threshold.

13. The machine-readable storage medium of claim 10, further comprising instructions for reducing power provided to a component of the print system when the amount of power exceeds a threshold.

14. A print system comprising:

a processor to:

obtain an image to be printed on a substrate;

obtain a density profile of the image;

obtain a distance offset of nozzles to be used to print the image, wherein in the event that the nozzles are provided in columns on a print die, the distance offset comprises a distance between nozzles of the same color in different columns, wherein in the event that the nozzles are provided in columns on a print die, the distance offset comprises a distance between nozzles of a different color in different columns, wherein in the event that the nozzles are provided in columns on at least two print dies, the distance offset comprises a distance between nozzles of the same color on different print dies, and wherein in the event that the nozzles are provided on at least two printheads, the distance offset comprising a distance between adjacent printheads;

generate a power profile for printing the image, wherein the power profile is generated based on the density profile of the in and the distance offset, the power profile indicating an amount of power to be consumed over time to print the image; and print different portions of the image at different speeds according to the power profile.

15. The print system of claim 14, wherein the processor decreases the speed at which the image is printed when power consumption of the print system exceeds a threshold.

16. The print system of claim 14, wherein the processor increases the speed at which the image is printed when power consumption of the print system does not exceed a threshold.

17. The print system of claim 14, wherein the processor reduces power provided to a component of the print system when power consumption of the print system exceeds a threshold.

* * * * *